United States Patent [19]

Tahara et al.

[11] Patent Number: 4,950,189

[45] Date of Patent: Aug. 21, 1990

[54] ARRANGEMENT FOR SUPPORTING OUTBOARD MOTOR OF BOAT

[75] Inventors: Hideo Tahara; Nobuo Makihara, both of Yokosuka, Japan

[73] Assignee: Nissan Motor Co., Ltd., Yokohama, Japan

[21] Appl. No.: 288,355

[22] Filed: Dec. 22, 1988

[30] Foreign Application Priority Data

Dec. 24, 1987 [JP] Japan ..... 62-327778

[51] Int. Cl.[5] ..... B63H 21/26

[52] U.S. Cl. ..... 440/61; 440/53

[58] Field of Search ..... 440/53, 61, 63, 900; 248/641-643

[56] References Cited

U.S. PATENT DOCUMENTS 4,089,290 5/1978 Miles, Sr. et al. ..... 440/61
4,449,945 2/1984 Ferguson ..... 440/61
4,778,417 10/1988 Mixon, Jr. ..... 440/61

FOREIGN PATENT DOCUMENTS 61-12497 6/1986 Japan ..... 440/61

*Primary Examiner*—Joseph F. Peters, Jr.
*Assistant Examiner*—Edwin L. Swinehart
*Attorney, Agent, or Firm*—Pennie & Edmonds

[57] ABSTRACT

An outboard motor supporting arrangement includes a stern bracket fixed to a transom of a boat, a lift member which supports the outboard motor and which is connected with the stern bracket so that the lift member is movable up and down and swingable together with the outboard motor, a vertically extending tilt cylinder which is connected between the stern bracket and lift member for causing the lift member to move up and down, and a pair of horizontally extending trim cylinders which are provided between the stern bracket and lift member, for causing the lift member to swing. Each trim cylinder is pivotally supported on the stern bracket, and a rear end of each trim cylinder is provided with thrust rollers which rolls on the lift member. Alternatively, each trim cylinder is pivotally supported on the lift member, and the front end is provided with the thrust rollers abutting against the stern bracket.

13 Claims, 7 Drawing Sheets

ARRANGEMENT FOR SUPPORTING OUTBOARD MOTOR OF BOAT

REFERENCES TO RELATED APPLICATIONS

The commonly assigned, following U.S. Patent Applications relate to subject matter similar to that of the present application. (1) Ser. No. 129,551, filed on Dec. 7, 1987. (2) Ser. No. 129,561, filed on Dec. 7, 1987.

BACKGROUND OF THE INVENTION

The present invention relates to a boat outboard motor supporting arrangement for tilting and trimming the outboard motor.

One conventional example is disclosed in Japanese Patent Provisional Publication No. 61-12497. In an outboard motor supporting arrangement of this example, an outboard motor is attached to a boat transom through a clamp in which there is provided a trim cylinder for trimming the outboard motor.

However, this conventional arrangement is arranged to trim the outboard motor only at a predetermined position, so that this arrangement is unable to adjust the posture of the outboard motor relative to the boat in a sufficiently flexible manner.

A U.S. Pat. No. 4,449,945 discloses a similar outboard motor supporting arrangement, which has a similar disadvantage.

SUMMARY OF THE INVENTION

It is therefore an object of the present invention to provide an outboard motor supporting arrangement which can place the outboard motor at a wide variety of positions, and make the boat assume a wide variety of postures.

According to the present invention, an arrangement for supporting an outboard motor of a boat, comprises stationary means, such as a stern bracket, adapted to be fixed to a rear end of the boat, movable means, such as a lift member, for supporting the outboard motor, and first and second actuator means. The movable means is connected with the stationary means so that the movable means is movable up and down, and swingable about a swing axis. The first actuator means, such as a tilt cylinder, is provided, between the stationary means and movable means, for causing the movable means to move up and down, together with the outboard motor, with respect to the stationary means. The second actuator means, such as trim cylinders, is provided, between the stationary and movable means, for causing the movable means to swing about the swing axis.

Preferably, one of the stationary and movable means comprises guide rail means extending up and down, the other of the stationary and movable means comprises support means for supporting the second actuator means, and the second actuator means comprises a pivot end swingably connected with said support means, and a slide end which moves along the guide rail means when the movable means moves up and down.

Thus, the second actuator means is mounted on a first one of the stationary and movable means, and the slide end of the second actuator means is not connected with a second one of the stationary and movable means but movable on the second means up and down.

DETAILED DESCRIPTION OF THE INVENTION

A first embodiment of the present invention is shown in FIGS. 1–7.

Figure 3:
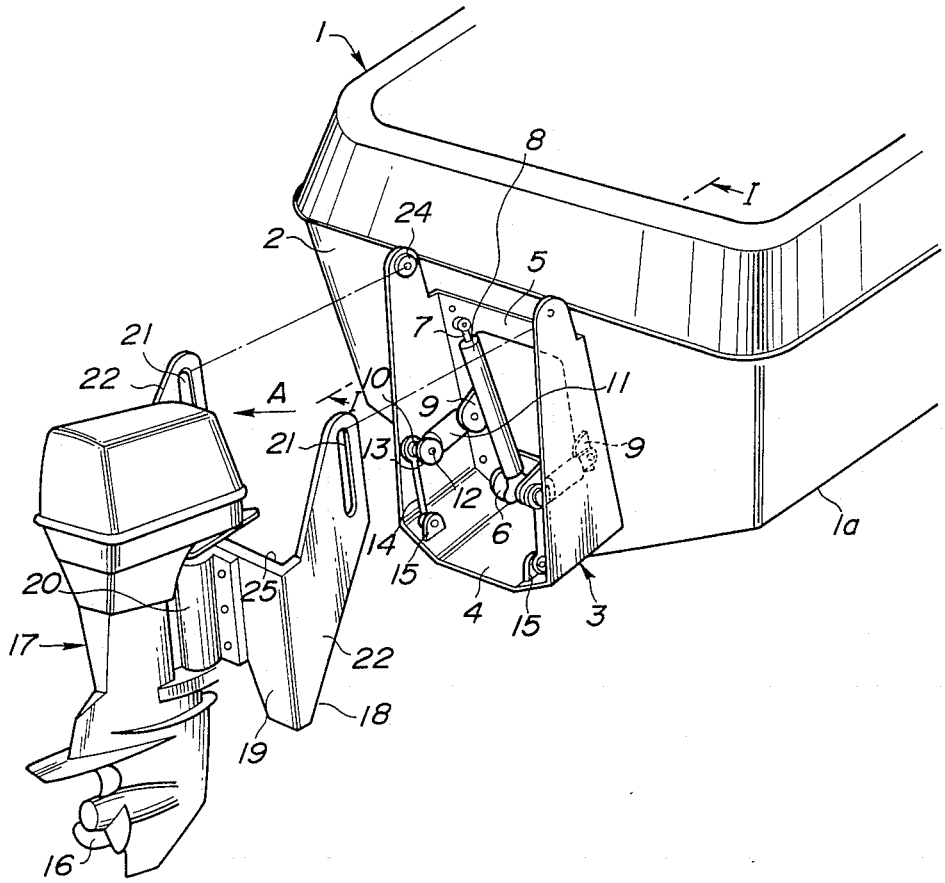
FIG. 3 is an exploded perspective view of the arrangement of FIG. 1.

As shown in FIG. 3, a hull 1 of a boat has an aft end in the form of a transom 2. A stern bracket 3 is fixed to a rear surface of the transom 2. The stern bracket 3 is approximately U-shaped, and has a deflector bottom plate portion 4 and a mounting plate portion 5, which are both integral parts of the stern bracket 3. The mounting portion 5 is fixed to the transom 2. The mounting portion 5 has a rectangular opening, as shown in FIG. 3.

A tilt cylinder bracket 6 is fixed to the mounting portion 5 at a lower position. The tilt cylinder bracket 6 projects rearwardly from the mounting portion 5. A tilt cylinder 8 extends substantially vertically from the tilt cylinder bracket 6. The tilt cylinder 8 consists of a cylinder housing whose lower blind end is pivotally supported on the tilt cylinder bracket 6, and a piston rod 7 which is slidably received in the cylinder housing and projects upwardly from the cylinder.

Figure 4:
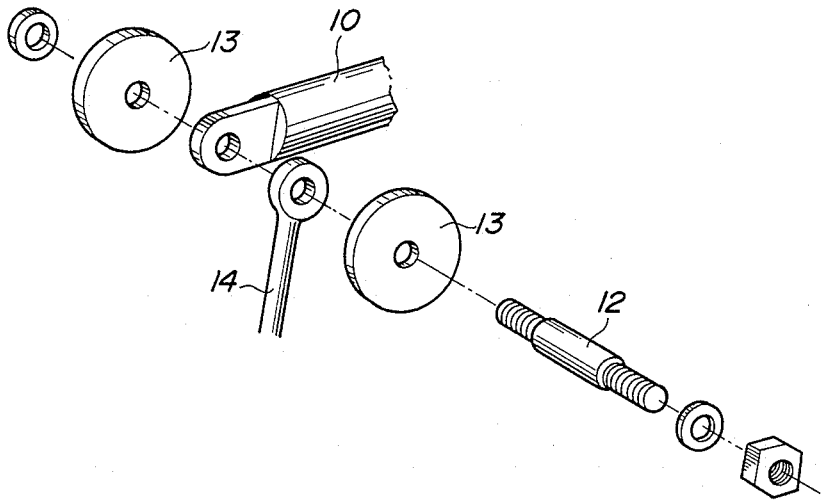
FIG. 4 is an exploded perspective view showing thrust rollers of the arrangement of FIG. 1.

A pair of trim cylinder brackets 9 are fixed to the mounting portion 5 at left and right positions. Each trim cylinder bracket 9 projects rearwardly from the mounting portion 5. A pair of left and right trim cylinders 11 extend rearwardly from the left and right trim cylinder brackets 9, respectively. The trim cylinders 11 extend substantially along the fore and aft axis of the boat. Each of the trim cylinders 11 consists of a cylinder housing whose rear blind end is pivotally supported on one of the trim cylinder brackets 9, and a piston rod 10 which is slidably received in the cylinder housing, and projects rearwardly from the cylinder housing. A rear end of the piston rod 10 of each trim cylinder 11 is swingably connected with an upper end of a link 14 through a pin 12. As shown in FIG. 4, a pair of thrust rollers 13 are rotatably mounted on the pin 12. Each of the links 14 on the left and right sides extends downwardly, and terminates at a lower end which is pivotally connected with one of left and right link brackets 15. The link brackets 15 are fixed to the upper surface of the bottom portion 4 of the stern bracket 3, and project upwardly. On each side, the rear end of the piston rod 10, the upper end of the link 14, and the thrust rollers 13 are all mounted on the same pin 12.

As shown in FIG. 3, a lift member 18 is connected with an outboard motor 17 which includes a propeller 16. The lift member 18 has a back plate portion 19, and left and right arms 22 extending forwardly from left and right ends of the back plate portion 19, respectively. A steering axis tube member 20 is fixed to a rear surface of the back plate portion 19. The steering axis tube member 20 is swingably connected with the outboard motor 17. Each of the left and right arms 22 is formed with a slit 21 extending substantially vertically. The lift member 18 is swingably connected with an upper end of the stern bracket 3 by a shaft 23 which passes through the slits 21 of the left and right arms 22, and which is received in holes formed in the upper end of the stern bracket 3. Guide rollers 24 are mounted on the shaft 23. The shaft 23 may be a single piece or may consist of left and right shafts.

Figure 2:
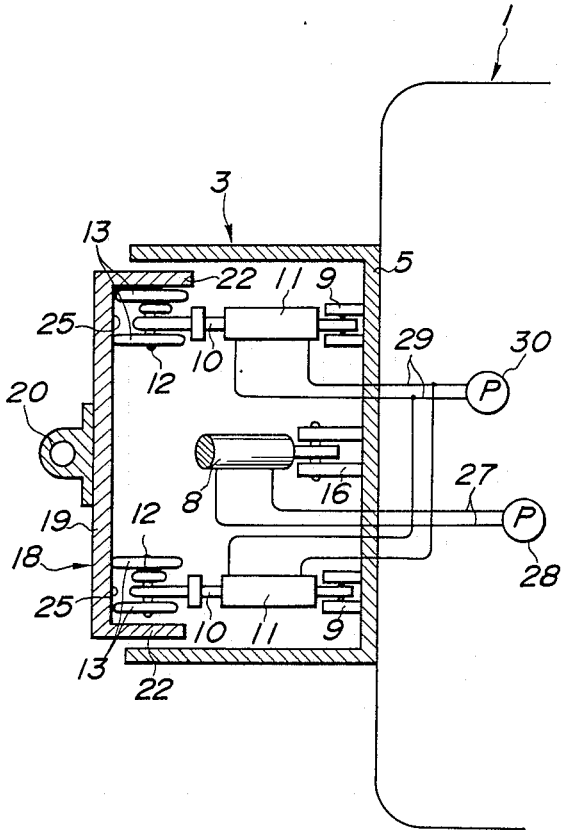
FIG. 2 is a sectional view taken across a line II—II of FIG. 1.
Figure 5:
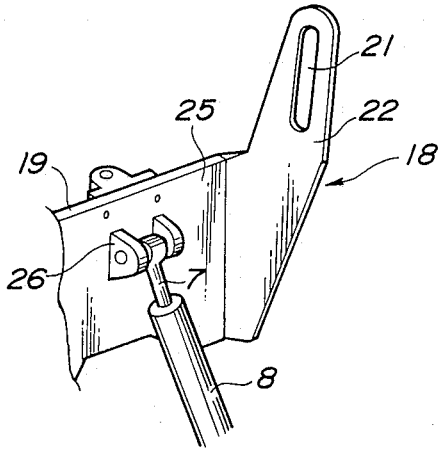
FIG. 5 is a partial perspective view as viewed from a direction shown by an arrow A of FIG. 3.

In the assembly of the stern bracket 3 and the lift member 18, the thrust rollers 13 abut on left and right guide rail portions 25 provided in a front surface of the back plate portion 19 of the lift member 18, as shown in FIG. 2. Each guide rail portion 25 is flat, and extends substantially vertically. The upper end of the rod 7 of the tilt cylinder 8 is pivotally connected with an input bracket 26 which is fixed to the front surface of the back plate portion 19 between the left and right guide rail portions 25, as shown in FIG. 5.

Figure 1:
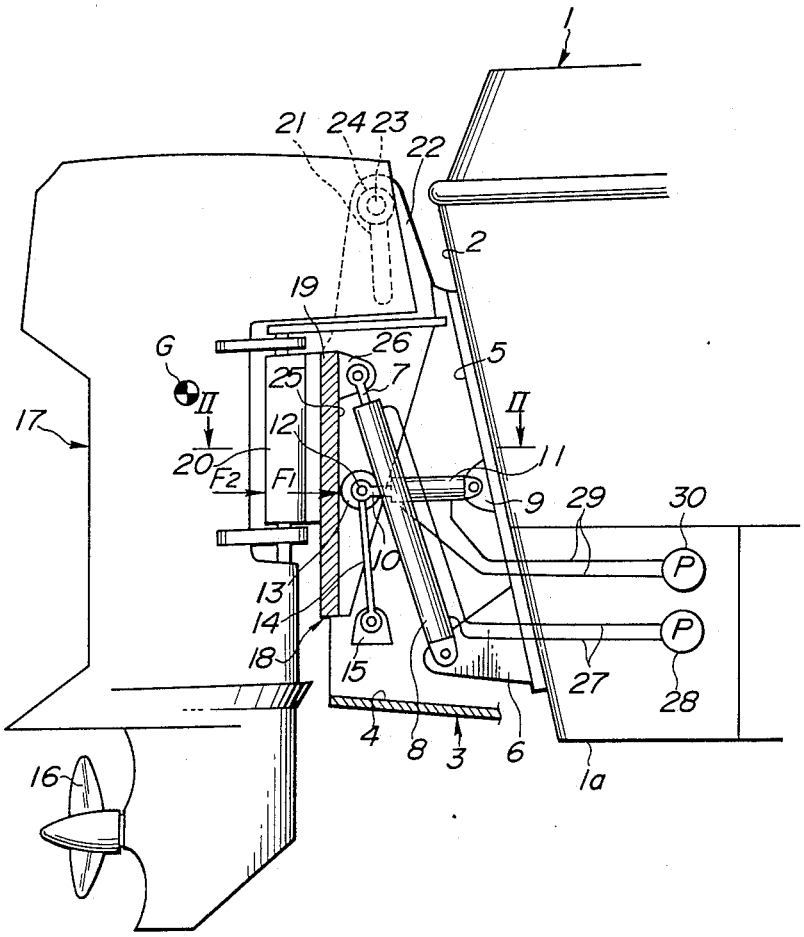
FIG. 1 is a sectional view, taken across a line I—I of FIG. 3, of an outboard motor supporting arrangement of a first embodiment of the present invention.

The tilt cylinder 8 is connected with a tilt pump 28 by tilt oil pipes 27, as shown in FIGS. 1 and 2. There is further provided a tilt switch in an electric power source circuit of the tilt pump 28. The left and right trim cylinders 11 are connected with a trim pump 30 by trim oil pipes 29. A trim switch is provided in an electric power source circuit of the trim pump 30.

In this arrangement, the thrust rollers 13 are pushed by the back plate portion 19 with a force F which is the resultant of a forward force $F_1$ due to a weight acting through a center of gravity G of the outboard motor 17, and a forward force due to a forward thrust of the propeller 16, as shown in FIG. 1. That is, $F=F_1+F_2$. This resultant force F acts from the steering axis tube member 20, through the back plate 19, the thrust rollers 13, the trim cylinders 11, and the trim cylinder brackets 9, on the transom 2. Thus, the transom 2 is pushed forwardly with this resultant force F. In this arrangement, the trim cylinders 11 are held substantially horizontally in parallel to the fore and aft axis of the boat by the links 14, and the thrust rollers 13 are firmly held at fixed vertical positions. Therefore, the resultant force F is effectively transmitted to the transom 2.

When the tilt pump 28 is put in operation by turning on the tilt switch, then the rod 7 projects upwardly, and the tilt cylinder 8 expands and raises the outboard motor 17 with the lift member 18. During this movement, the slits 21 move upwardly, so that the shaft 23 and the guide rollers 24 move downward relative to the lift member 18 along the slits 21. At the same time, the thrust rollers 13 roll downwardly relative to the lift bracket 18 along the guide rails 25. In this way, the tilt cylinder 8 can hold the outboard motor 17 at a desired height by fixing its length, and lower the outboard motor 17 by contracting. The tilt cylinder 8 enables the tilting operation of the outboard motor 17.

When the trim pump 30 is put in operation by turning on the trim switch, then each trim cylinder 11 expands, and each piston rod 10 pushes the back plate 19 through the thrust roller 13. Therefore, the lift member 18 and the outboard motor 17 swing rearwardly about the shaft 23.

The trim cylinders 11 can hold the outboard motor 17 stationary at a desired angle by fixing the length of the cylinders 11, and cause the outboard motor 17 to swing forwardly by contracting. In this way, the trim cylinders 11 enable the trimming operation of the outboard motor 17.

Figure 6:
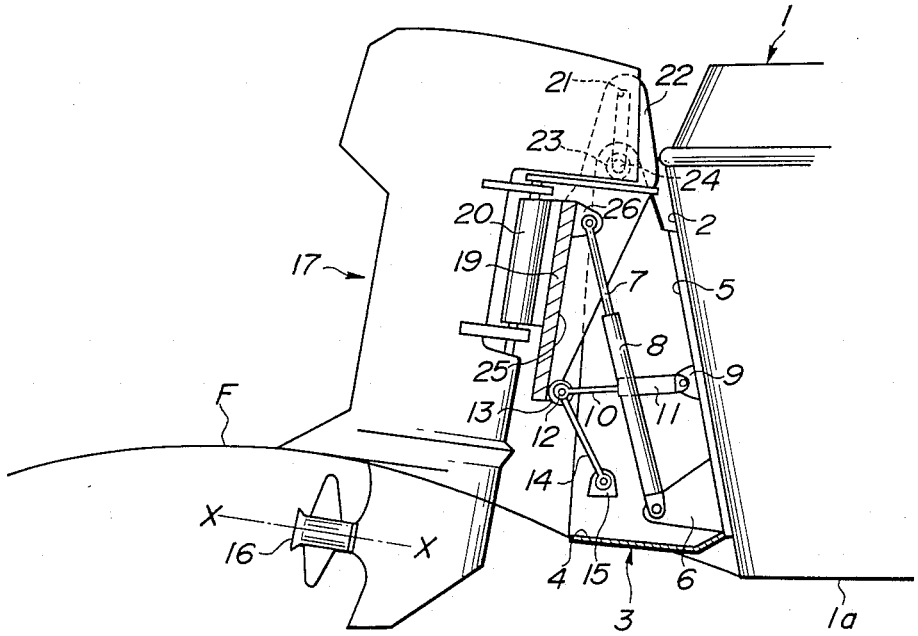
FIGS. 6 and 7 are sectional views, taken across a line I—I of FIG. 3, of the arrangement of the first embodiment, for showing two different positions of the outboard motor.

In this way, this arrangement makes it possible to place the outboard motor 17 at the best height and at the best angular position for the propulsion efficiency in a high speed operation by tilting and trimming the outboard motor 17 appropriately. During travel over a shoal, the position shown in FIG. 6 is desirable. This position is easily attained by first lifting up the outboard motor 17 by expanding the tilt cylinder 8 until the lower ends of the slits 21 reach the shaft 23, and then causing the outboard motor 17 to swing rearwardly by expanding the trim cylinders 11. In this position, the propeller 16 is located near an extension of a bottom 1*a* of the boat to prevent collision between the propeller 16 and the sea bottom. Furthermore, the axis (X—X) of the propeller 16 can be oriented in agreement with a line F of water flow, as shown in FIG. 6, so that the propulsion efficiency can be improved. Thus, this arrangement can put the outboard motor 17 in various postures.

Figure 7:
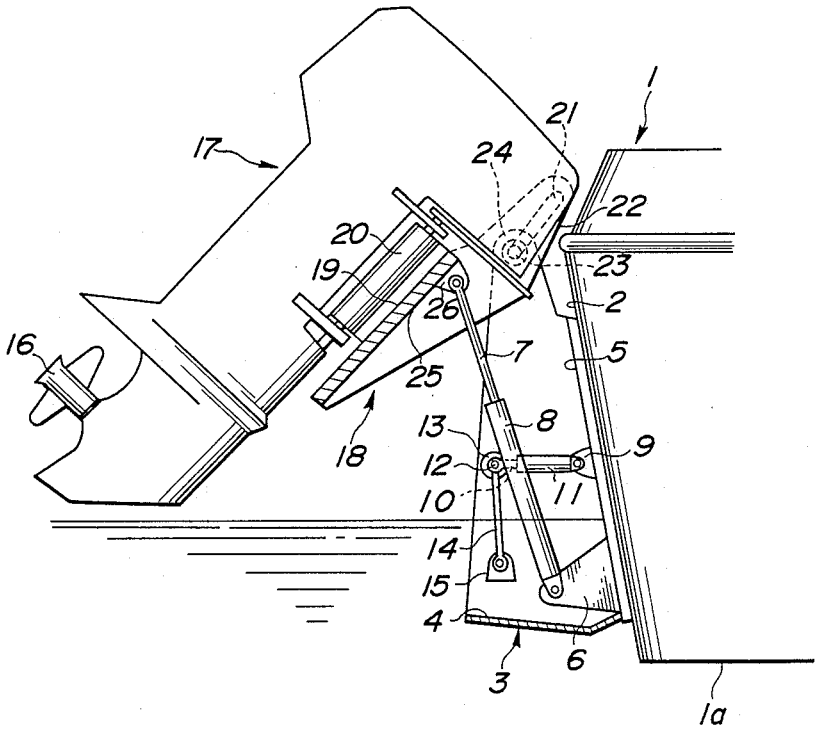

The position shown in FIG. 7 is desirable when the boat is at rest. This position is attained by expanding the tilt cylinder 8 to the longest state. In this position, the outboard motor 17 is raised and swung above the water surface, so that the durability of the outboard motor 17 is improved.

Figure 8:
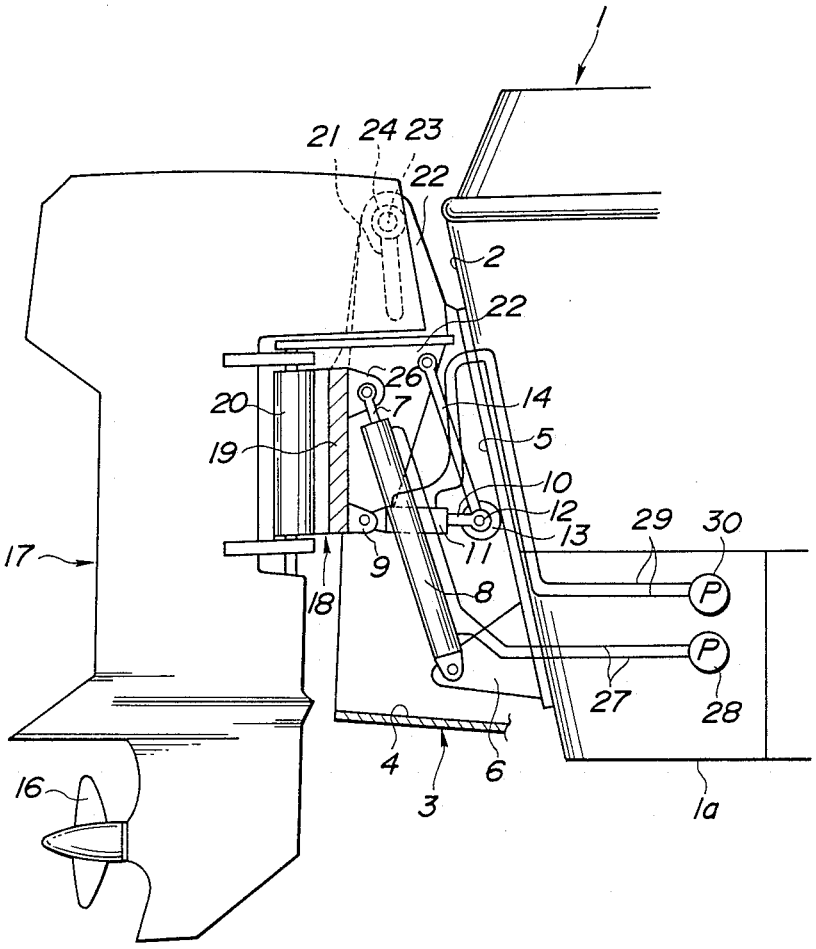
FIG. 8 is a sectional view, similar to FIG. 1, but showing a second embodiment of the present invention.

A second embodiment of the present invention is shown in FIG. 8. In the second embodiment, the trim cylinders 11 are pivotally supported on the trim cylinder brackets 9 which are fixed to the front surface of the back plate portion 19 of the lift member 18. The left and right links 14 are pivotally connected with the left and right arms 22 of the lift member 18 by suitable means such as pins. The thrust rollers 13 are provided at the front ends of the piston rods 10 projecting forwardly, and the thrust rollers 13 abut on the mounting portion 5 of the stern bracket 3 (, or on the transom 2).

When the tilt cylinder 8 is expanded and contracted, the trim cylinders 11 move up and down together with the lift member 18, and the thrust rollers 13 roll up and down on the mounting portion 5 (or the transom 2). In the second embodiment, the guide rail portions 25 are formed in the mounting portion 5 of the stern bracket 3 (, or the transom 2). There is no need for forming the guide rail portions 25 in the back plate 19. Therefore, it is possible to reduce the vertical dimension of the back plate 19 as shown in FIG. 8, and accordingly it is possible to reduce the weight of the lift member 18. The trim oil pipes 29 are passed through holes formed in an upper portion of the transom 2 in order to prevent interference with the trim cylinders 11 which move up and down with the lift member 18.

What is claimed is:

1. An arrangement for supporting an outboard motor of a boat, comprising;

stationary means adapted to be fixed to a rear end of said boat, movable means for supporting said outboard motor, said movable means being connected with said stationary means so that said movable means is movable up and down, and said movable means is swingable about a swing axis, first actuator means provided between said stationary and movable means for causing said movable means to move up and down, and second actuator means provided between said stationary and movable means for causing said movable means to swing about said swing axis, wherein one of said stationary and movable means comprises guide rail means extending up and down, and comprises support means for supporting said second actuator means, and wherein said second actuator means, has a pivot end swingably connected with said support means, and a slide end which moves relative to and in contact with said guide rail means when said movable means moves up and down.

2. An arrangement according to claim 1 wherein said arrangement further comprises link means for extending between said slide end of said second actuator means and said support means, and swingably supporting said slide end of said second actuator means on said support means.

3. An arrangement for supporting an outboard motor of a boat, comprising:

stationary means adapted to be fixed to a rear end of said boat;

movable means for supporting said outboard motor, said movable means being connected with said stationary means so that said movable means is movable up and down, and said movable means is swingable about a swing axis;

first actuator means provided between said stationary and movable means for causing said movable means to move up and down;

second actuator means provided between said stationary and movable means for causing said movable means to swing about said swing axis, wherein one of said stationary and movable means comprises guide rail means extending up and down, and comprises support means for supporting said second actuator means, and wherein said second actuator means has a pivot end swingably connected with said support means and a slide end, and wherein a roller end which is rotatably mounted on said slide end is capable of rolling along and in contact with said guide rail means, and wherein a link means extends between said slide end of said second actuator means and said support means, and swingably supports said slide end of said second actuator on said support means.

4. An arrangement according to claim 3 wherein said first actuator means comprises a first hydraulic cylinder actuator extending substantially vertically, and having an upper end swingably connected with said movable means and a lower end swingably connected with said stationary means, and said second actuator means comprises left and right second hydraulic cylinder actuators each of which extends substantially horizontally from said slide end to said pivot end.

5. An arrangement according to claim 4 wherein said stationary means comprises a stern bracket which is fixed to a transom of said boat, and which has an upper portion supporting shaft means extending along said swing axis, and said movable means comprises a lift member having left and right arm portions each of which is formed with a slit which slidably receives said shaft means so as to allow said lift member to move up and down and swing about said shaft means.

6. An arrangement according to claim 5 wherein said support means comprises left and right second cylinder brackets which are fixed to said stern bracket for swingably supporting said pivot ends of said left and right second cylinder actuators, and left and right link brackets which are fixed to said stern bracket, and wherein said link means comprises left and right links each of which has a lower end swingably connected with one of said link brackets, and an upper end swingably connected with said slide end of one of said left and right second cylinder actuators.

7. An arrangement according to claim 5 wherein said support means comprises left and right second cylinder brackets which are fixed to said lift member for swingably supporting said pivot ends of said second cylinder actuators, and left and right link support means which are mounted on said lift member, and wherein said link means comprises left and right links each of which has an upper end swingably connected with said lift member by one of said left and right link support means, and a lower end swingably connected with said slide end of one of said left and right second cylinder actuators.

8. A boat comprising:

a body;

an outboard motor;

stationary means fixed to a rear end of said body;

movable means which supports said outboard motor, said movable means being connected with said stationary means so that said movable means is movable substantially along a vertical axis of said body, and said movable means is swingable about a swing axis;

first actuator means provided between said stationary and movable means for causing said movable means to move substantially along said vertical axis; and second actuator means provided between said stationary and movable means for causing said movable means to swing about said swing axis, wherein said movable means comprises a guide rail portion, and said stationary means comprises support means for supporting said second actuator means, and wherein said second actuator means has a pivot end swingably connected with said stationary means through said support means, and a slide end which moves on said guide rail portion relative to said movable means when said movable means moves substantially along said vertical axis.

9. A boat according to claim 8 wherein said swing axis is substantially parallel to a lateral axis of said body, and aft axis of said body.

10. A boat according to claim 9 wherein said swing axis is substantially parallel to a lateral axis of said body, and located above said second actuator means.

11. A boat comprising:

a body;

an outboard motor;

stationary means fixed to a rear end of said body;

movable means which supports said outboard motor, said movable means being connected with said stationary means so that said movable means is movable substantially along a vertical axis of said body, and said movable means is swingable about a swing axis;

first actuator means provided between said stationary and movable means for causing said movable means to move substantially along said vertical axis; and second actuator means provided between said stationary and movable means for causing said movable means to swing about said swing axis;

wherein said stationary means comprises a guide rail portion, and said movable means comprises support means for supporting said second actuator means, and wherein said second actuator means has a pivot end swingably connected with said movable means through said support means, and a slide end which moves on said guide rail portion relative to said stationary means where said movable means moves substantially along said vertical axis.

12. A boat according to claim 11 wherein said second actuator means is substantially parallel to a fore and aft direction of said body.

13. A boat according to claim 12 wherein said swing axis is substantially parallel to a lateral axis of said body, and located above said second actuator means.

* * * * *